United States Patent [19]

Braithwaite

[11] 4,159,796

[45] Jul. 3, 1979

[54] METHOD FOR MAKING A BOOM

[75] Inventor: Arthur B. M. Braithwaite, Ickleton, near Saffron Walden, England

[73] Assignee: Caterpillar Tractor Co., Peoria, Ill.

[21] Appl. No.: 809,571

[22] Filed: Jun. 23, 1977

Related U.S. Application Data

[62] Division of Ser. No. 712,555, Aug. 9, 1976, Pat. No. 4,069,637.

[51] Int. Cl.[2] ..... E02F 3/38; B23K 31/02

[52] U.S. Cl. ..... 228/151; 228/182

[58] Field of Search ..... 212/114, 17, 58 A, 58 R; 52/726, 730, 116, 731; 214/86 A; 29/155 R, 155 C; 228/173 C, 151, 152, 178, 182

[56] References Cited

U.S. PATENT DOCUMENTS

| | | | |
|---|---|---|---|
| 1,960,557 | 5/1934 | Snyder | 285/179 |
| 2,257,386 | 9/1941 | Kempe | 52/116 |
| 2,805,781 | 9/1957 | Senn | 212/58 A |
| 2,846,081 | 8/1958 | Moore | 212/17 |
| 2,924,341 | 2/1960 | Bähr et al. | 52/116 X |
| 2,973,112 | 2/1961 | Young | 214/83.1 |
| 3,361,320 | 1/1968 | Bobrowski | 228/17 |
| 3,375,937 | 4/1968 | Bradshaw | 212/58 R X |
| 3,902,295 | 9/1975 | Yancey | 52/730 |

*Primary Examiner*—C. W. Lanham
*Assistant Examiner*—K. J. Ramsey
*Attorney, Agent, or Firm*—Phillips, Moore, Weissenberger, Lempio & Majestic

[57] ABSTRACT

A boom is made by joining two tubular members to a cast iron elbow section. The tubular members are made from plate formed into tubes with a longitudinally welded seam. The tube seams are located below a horizontal axis of the respective tube members and circumferentially between the horizontal and vertical axes thereof to dispose the weld seam on a lower side of the boom. Pivotal boom connection means are further welded to each free end of the boom and to the elbow section.

4 Claims, 5 Drawing Figures

50
74
X
Y
34
84
86
80
82
III
IV
V
76
64
66
46
70
68
48
72
52
56
54
78
58
62
60
30

METHOD FOR MAKING A BOOM

This is a division of Ser. No. 712,555, filed Aug. 9, 1976 now U.S. Pat. No. 4,069,637.

BACKGROUND OF THE INVENTION

The present invention relates to structural members and pertains particularly to booms and the like and method of constructing such booms for hydraulic excavators and the like.

Implement carrying booms for hydraulic excavators and the like are continuously subjected to torsional and bending loads of a high magnitude. Such booms are normally constructed of a box-like section such as that disclosed for example in U.S. Pat. No. 3,882,654, issued May 13, 1975, and U.S. Pat. No. 3,902,295, issued Sept. 2, 1975, both issued to Yancey, and both assigned to the assignee hereof. The fabrication of such box section booms requires a considerable amount of welding. Such welding is normally the most practical way of achieving the desired structural configurations.

While such box structures as mentioned above are well suited to heavy bending loads, such structures are not well suited to torsional loads. Such torsional loads on box-section booms impose high and uneven torsional compressive and tensional stresses on certain sections of the boom structure.

In addition to the above-mentioned patents, other patents of interest in the prior art include U.S. Pat. No. 1,974,458 issued Sept. 25, 1934 to Hallquist; U.S. Pat. No. 2,910,190, issued Oct. 27, 1959 to Baas; and U.S. Pat. No. 3,186,063, issued June 1, 1965 to Dopp.

SUMMARY AND OBJECTS OF THIS INVENTION

The present invention is directed to overcoming one or more of the problems as set forth above.

This invention is directed to a method for expeditiously and economically making a boom which will exhibit a high degree of structural integrity to withstand both bending and torsional loads imposed thereon. The method comprises the steps of cutting and rolling a pair of plates into tubular members and welding longitudinally extending abutting edges of each member together. The longitudinally extending weld seam thus formed is located below a horizontal axis of the member and circumferentially between such horizontal axis and a vertical axis of the member when the member is viewed in cross section to thus dispose the weld seam on a lower side of the beam. An elbow secures the two members together.

The fabricated boom exhibits a high degree of structural integrity to withstand both bending and torsional loads and can be formed expeditiously and economically.

BRIEF DESCRIPTION OF THE DRAWING

The above and other objects and advantages of the present invention will become apparent from the following description when read in conjunction with the drawings wherein.

DETAILED DESCRIPTION

Figure 1:
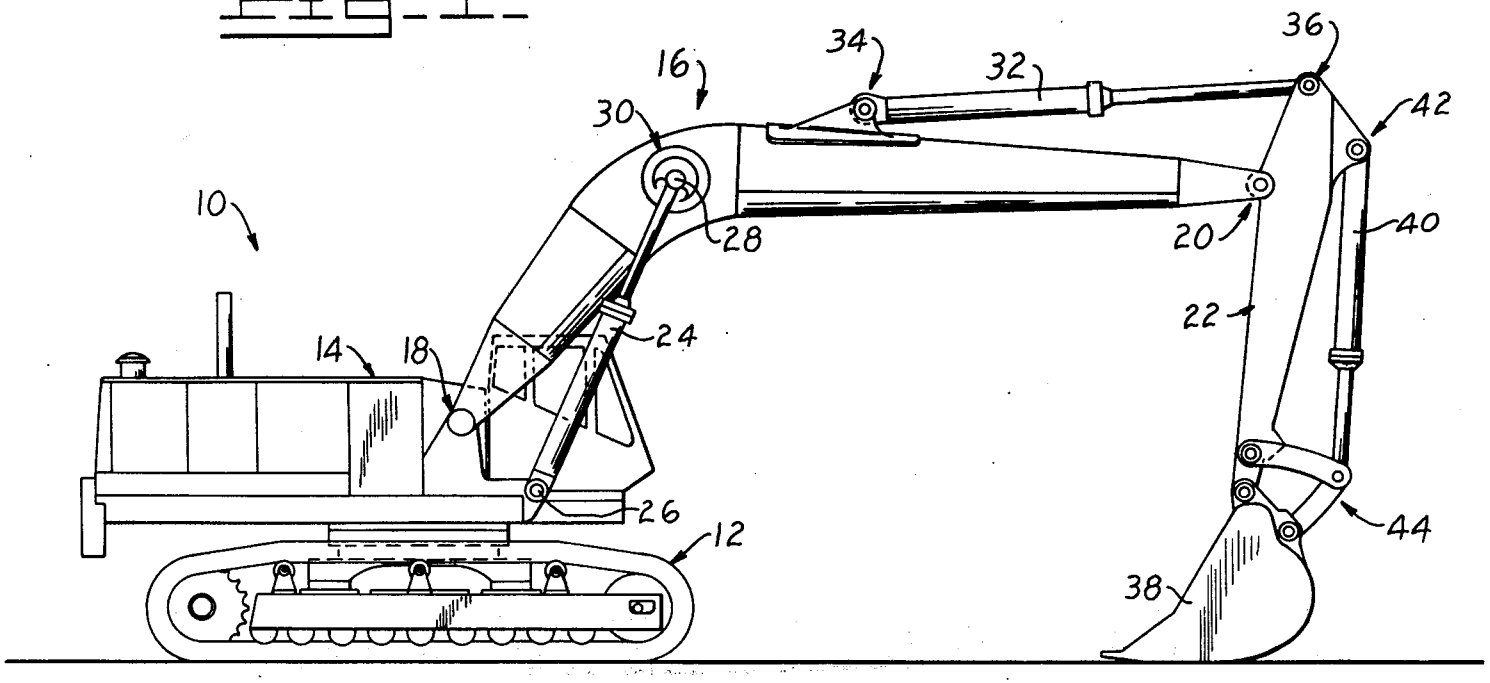
FIG. 1 is a side elevational view of an excavator incorporating a preferred embodiment of the present invention.

Turning now to FIG. 1 of the drawing there is illustrated an excavator designated generally by the numeral 10 comprising an undercarriage of the track type 12 on which is rotatably mounted an upper platform 14. A boom designated generally by the numeral 16 includes an inner end 18 pivotally mounted for vertical movement about a horizontal axis to the upper platform 14 and an outer end 20 to which is pivotally mounted a jib or stick 22.

One or more boom lift cylinders 24 are pivotally connected at a lower end pivot 26 to the upper platform 14 and at the upper end 28 to a center connecting mounting means 30 for manipulating the boom by suitable hydraulic control means.

A stick cylinder 32 is connected at one end 34 to suitable bracket or connecting means on the boom 16 and at the other end 36 to the upper end of the stick 22 for manipulating the stick. A bucket 38 is pivotally mounted on the lower end of the stick 22 and is manipulated by the bucket cylinder 40 connected at its upper end 42 to the stick and at the lower end by suitable bucket linkage means 44 for manipulating the bucket.

The bucket is in the usual manner for digging and lifting heavy loads of earthen material and for handling articles and the like around construction sites. The bucket is also frequently used for demolition work for knocking down buildings and the like and in many instances of its use side loadings are imposed on the bucket and the stick. These side loadings impose torsional stresses on the boom that tend to twist it about its longitudinal axis. In order to maximize the utility of the excavator machine the boom must be capable of withstanding such torsional loads as well as the bending loads imposed by lifting and digging.

Figures 2, 3, 4, 5:
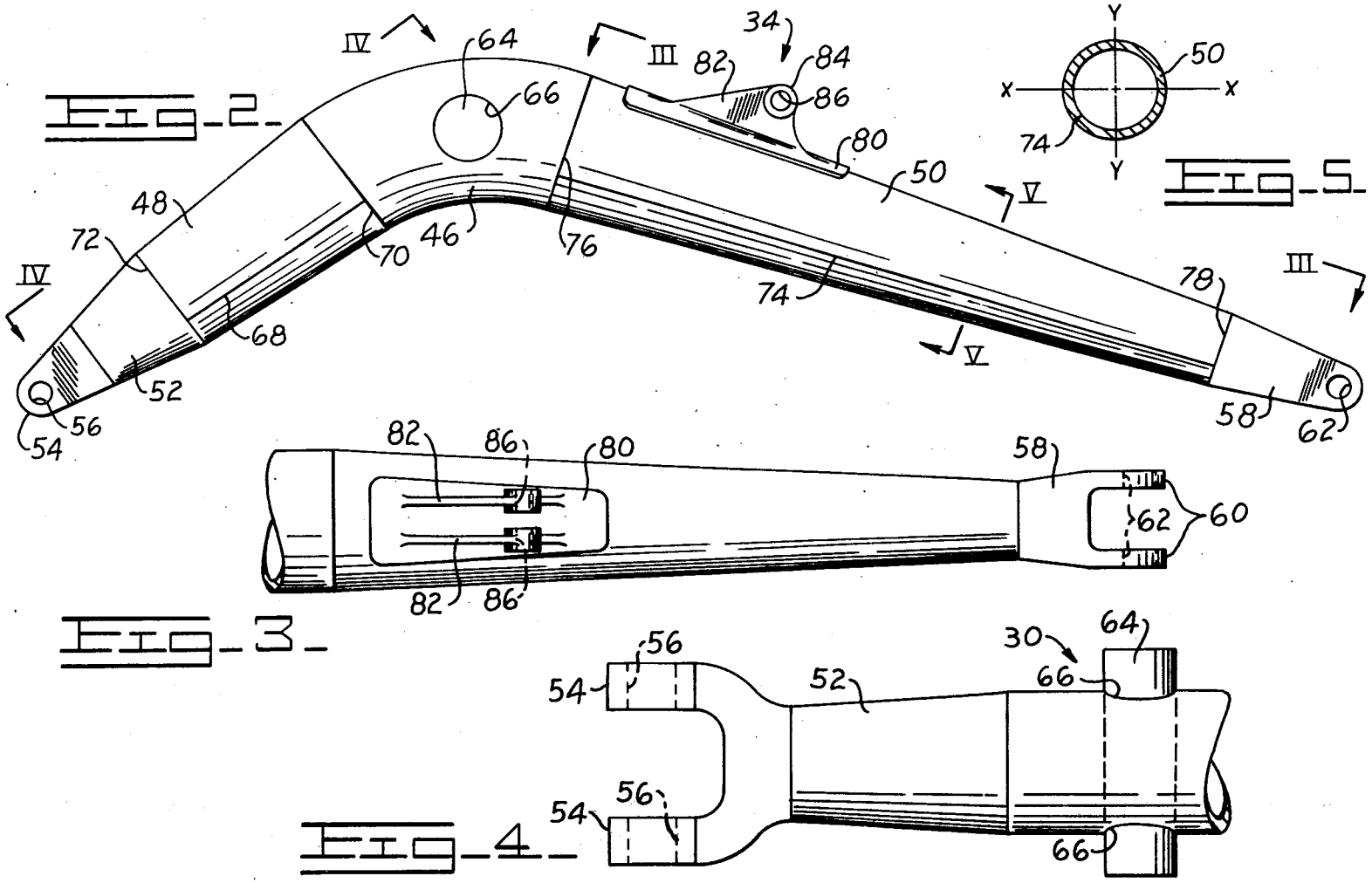
FIG. 2 is a side elevational view of a preferred embodiment of the present invention.
FIG. 3 is a view taken generally along lines III—III of FIG. 2.
FIG. 4 is a view taken generally along lines IV—IV of FIG. 2.
FIG. 5 is a sectional view taken along lines V—V of FIG. 2.

Turning now to FIG. 2, the boom as illustrated is formed in a generally L configuration and comprises a main body comprising a central cast formed elbow member 46 forming the apex of the boom structure and having first and second tapered tubular members 48 and 50 secured thereto. First connecting means 52 for pivotally mounting the boom to suitable support structure comprises a cast formed member having a generally yoke configuration as best seen in FIG. 4 and a pair of spaced aligned bearing brackets 54 having bearing bores 56 for receiving bushings or the like.

A similar mounting or connecting member 58 is secured to the outer end of the boom and specifically to the outer end of tubular member 50 and similarly as seen in FIG. 3 comprises a yoke like structure having spaced apart bearing brackets 60. Aligned bores 62 for receiving bearings or bushings are formed in the respective brackets 60.

The connecting means indicated generally at 30 for connecting the lift cylinders to the boom comprises an elongated cylindrical pin 64 extending through aligned bores 66 (extending through the center of the central elbow member 56.

This tubular design as described will withstand torsional loads such as resulting from side loadings on the stick and bucket much better than conventional rectangular or square boxed designs because of the uniform distribution of stresses within the boom member. This construction also limits the number of welding procedures required and thus because of its simplicity the welding can be much better controlled. Moreover, the amount of weld required can be reduced by approximately two-thirds. It has also been found that this tubular construction can be much lighter in weight for the same relative strength.

METHOD OF FABRICATION

The method of construction or fabrication of the boom in accordance with the present invention includes cast forming the central elbow section 46 to have a substantially uniform circular cross section and diameter throughout its length. The member 46 can be cast formed with the pin member 64 in place or the member can be cast formed with a bore for receiving the pin 64 which may be later inserted and welded in place.

The inner end of the boom 48 and the outer end 50 are similarly constructed from steel plates which are rolled into a tubular form and welded along abutting edges. The member 48 may be of a straight tubular construction or may be tapered as desired. The plate is rolled into the tubular form with edges in abutment and a continuous weld 68 formed along longitudinally of the tubular member 48. After this tubular member has been formed it may be connected to the elbow member 46 in a suitable manner by a continuous annular weld means 70.

The inner end connecting member 52 is cast formed and connected by continuous annular weld means 72 to the inner end of the tubular member 48. The bores 56 are machined in the usual manner to receive a suitable pivot pin for pivotally mounting the inner end of the boom to suitable support structure such as the upper platform of an excavator machine.

The outer or second boom member 50 is constructed similar to the previous tubular member by rolling a plate into the tubular shape with abutting edges connected together by a continuous elongated longitudinally extending weld means 74. This tubular member 50 is preferably tapered as shown from a maximum diameter at the inner end connected to the elbow 46 to a minimum diameter at the outer end connected to the connecting means 58. The tubular member 50 is connected by suitable weld means in the form of a continuous annular weld means 76 to the elbow member 46. The outer connecting means or member 58 is likewise attached to the outer end of the tubular member 50 by continuous annular weld means 78.

The longitudinally extending weld means and seams 68 and 74 are preferably located at a position below a horizontal axis and between the horizontal and the vertical axis as viewed along the axis of the tubular member as seen in FIG. 5. This location of the weld means and the seam formed thereby moves it from the high stress area that would otherwise be found.

As will be appreciated from viewing the prior art as mentioned in the background, the present construction requires considerably fewer weld seams and considerably fewer steps in fabrication. Also because of the simplicity of the design the welding can be carried out automatically. The various components once formed may be positioned in a jig or fixture and the welding operations then carried out for the final fabrication.

A suitable bracket generally indicated by the numeral 34 for the attachment of the stick cylinder includes a base member portion 80 suitably secured such as by welding to the upper surface of member 50 and an upwardly extending body portion 32 with spaced bracket means 84 having appropriate pin receiving bores 86 formed therein.

While the present invention has been described by means of specific embodiments, it is to be understood that numerous changes and modifications may be made therein without departing from the spirit and scope of the invention as defined in the appended claims.

What is claimed is:

1. A method of making a boom comprising the steps of cutting first and second plates;

rolling said plates into first and second tubular members, each having a circular cross section and abutting edges extending longitudinally thereof;

welding said abutting edges together by forming a longitudinally extending weld seam which is located at a position below a horizontal axis of a respective one of said tubular members and circumferentially between the horizontal axis and a vertical axis of said respective one of said tubular members, when such tubular member is viewed in cross section, whereby said weld seam is disposed on a lower side of said boom;

selecting elbow means having a circular cross section on each end thereof equal to the cross section of one end of each of said tubular members; and welding said one end of each of said tubular members to an end of said elbow.

2. The method of claim 1 further comprising the step of forming said elbow means by casting.

3. The method of claim 2 further comprising the step of securing pivotal mounting means to each free end of said boom and to said elbow means.

4. The method of claim 1 further comprising the step of shaping each of said tubular members to taper from said one end thereof at said elbow to the other end thereof.

* * * * *